US005399084A

United States Patent [19]

McCullough et al.

[11] Patent Number: 5,399,084

[45] Date of Patent: Mar. 21, 1995

[54] GAS FIREPLACE BURNER

[76] Inventors: Sam McCullough, 2431 Sinclair Circle, Burlington, Ontario L7P 3K1, Canada; Russell E. Reyher, 3 Winfield Way, Winnipeg, Manitoba R2R 1V8, Canada

[21] Appl. No.: 167,179

[22] Filed: Dec. 16, 1993

[51] Int. Cl.[6] ..... F23Q 2/32

[52] U.S. Cl. ..... 431/125; 126/512; 126/92 R

[58] Field of Search ..... 431/125, 326, 328, 359; 126/92 R, 92 AC, 91 R, 512

[56] References Cited

U.S. PATENT DOCUMENTS

| | | | |
|---|---|---|---|
| 4,838,240 | 6/1989 | Rieger | 126/512 |
| 4,838,241 | 6/1989 | Rieger | 126/512 |
| 4,930,490 | 6/1990 | Allan | 126/512 |

FOREIGN PATENT DOCUMENTS

| | | | |
|---|---|---|---|
| 2198836 | 6/1988 | United Kingdom | 126/92 R |

*Primary Examiner*—James C. Yeung

[57] ABSTRACT

A gas fireplace burner comprises a support frame, a baffle internally of the support frame, a gas inlet to the burner through the support frame beneath the baffle, a top plate above the baffle and a gas distributor between the top plate and the baffle. The top plate has a substantially solid central region and front and back edge regions provided with a plurality of gas escape openings along the edge regions. The gas escape openings at the back edge region include major and minor openings. The gas distributor extends to all of the openings and the baffle which is shorter than the top plate is positioned directly beneath the major openings with some of the minor openings being located outwardly of the baffle.

5 Claims, 3 Drawing Sheets

GAS FIREPLACE BURNER

FIELD OF THE INVENTION

The present invention relates to a gas fireplace burner.

BACKGROUND OF THE INVENTION

Gas operated fireplaces are becoming ever more popular. There are many different burner designs for these gas fireplaces. The burners should produce a flame which is not only efficient for heating the fireplace but additionally be esthetically pleasing. A preferred flame pattern is one in which the flames are relatively small at the front of the fireplace with substantially more flame appearing centrally at the back of the fireplace.

SUMMARY OF THE INVENTION

In accordance with the present invention, a gas fireplace burner comprises a support frame, a baffle internally of the support frame, a gas inlet through the support frame beneath the baffle, a top plate above the baffle and a gas distributor between the top plate and the baffle. The top plate has a substantially solid central region and front and back edge regions having a plurality of gas escape openings along the edge regions. The gas escape openings at the back edge region include major and minor openings with the gas distributor extending to all of the openings and the baffle which is shorter than the top plate being positioned directly beneath the major openings with some of the minor openings being located outwardly of the baffle.

A gas fireplace having the above construction produces a highly desirable flame pattern by the appropriate distribution of the gas to the gas escape openings in the top plate.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
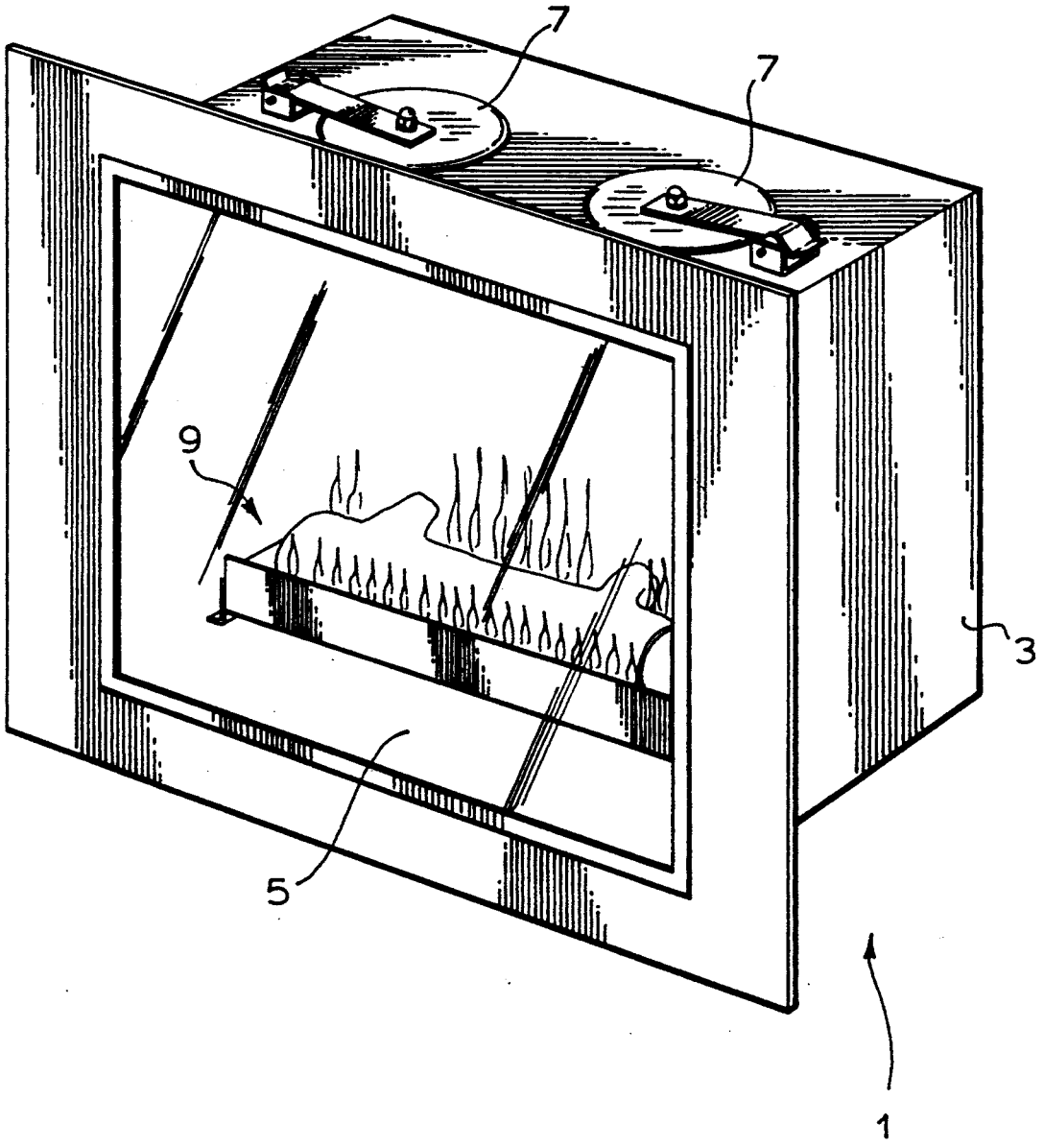
FIG. 1 is a front perspective view of the main body of a gas fireplace provided with a burner made in accordance with a preferred embodiment of the present invention.
Figure 3:
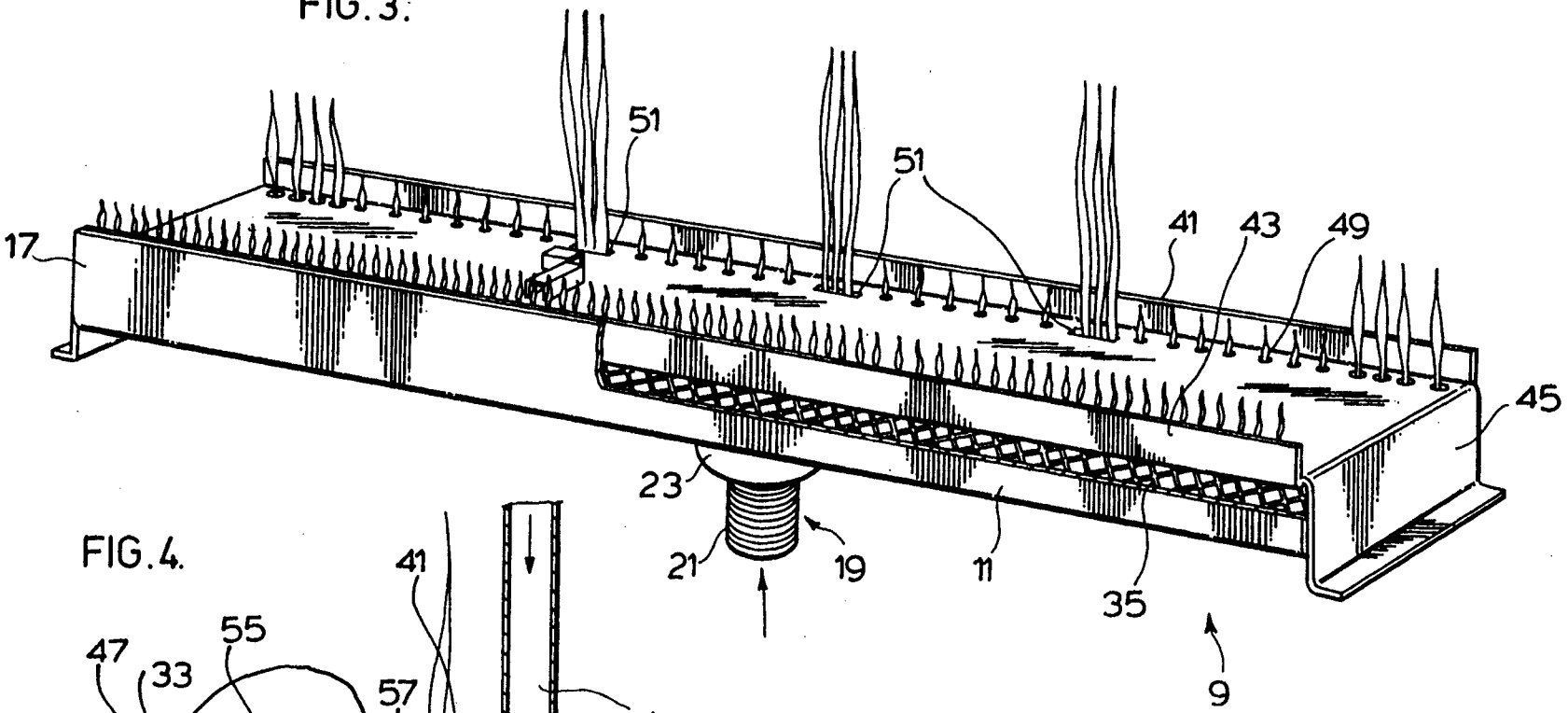
FIG. 3 is an assembled perspective view of the gas burner from FIG. 2.

FIG. 1 shows a gas burning fireplace generally indicated at 1. This fireplace includes a combustion chamber 3 with a forward viewing window 5 to the combustion chamber. Explosion dampeners 7 are provided on the top wall of the combustion chamber and a gas burner generally indicated at 9 is housed internally of the combustion chamber. A log arrangement comprising a series of non-combustible logs are seated on the burner. The logs have a specific shape and the flame pattern of the burner compliments the log shaping. As clearly seen in FIG. 1 and as also shown in FIG. 3 the flame pattern comprises a relatively low uniform flame at the front of the burner closest to the front viewing area of the fireplace with a much higher flame pattern at the back of the burner behind the logs. The back flame pattern itself is set up with midsize flames to the opposite ends of the logs and much higher flames to the center at the back of the burner.

Figure 2:
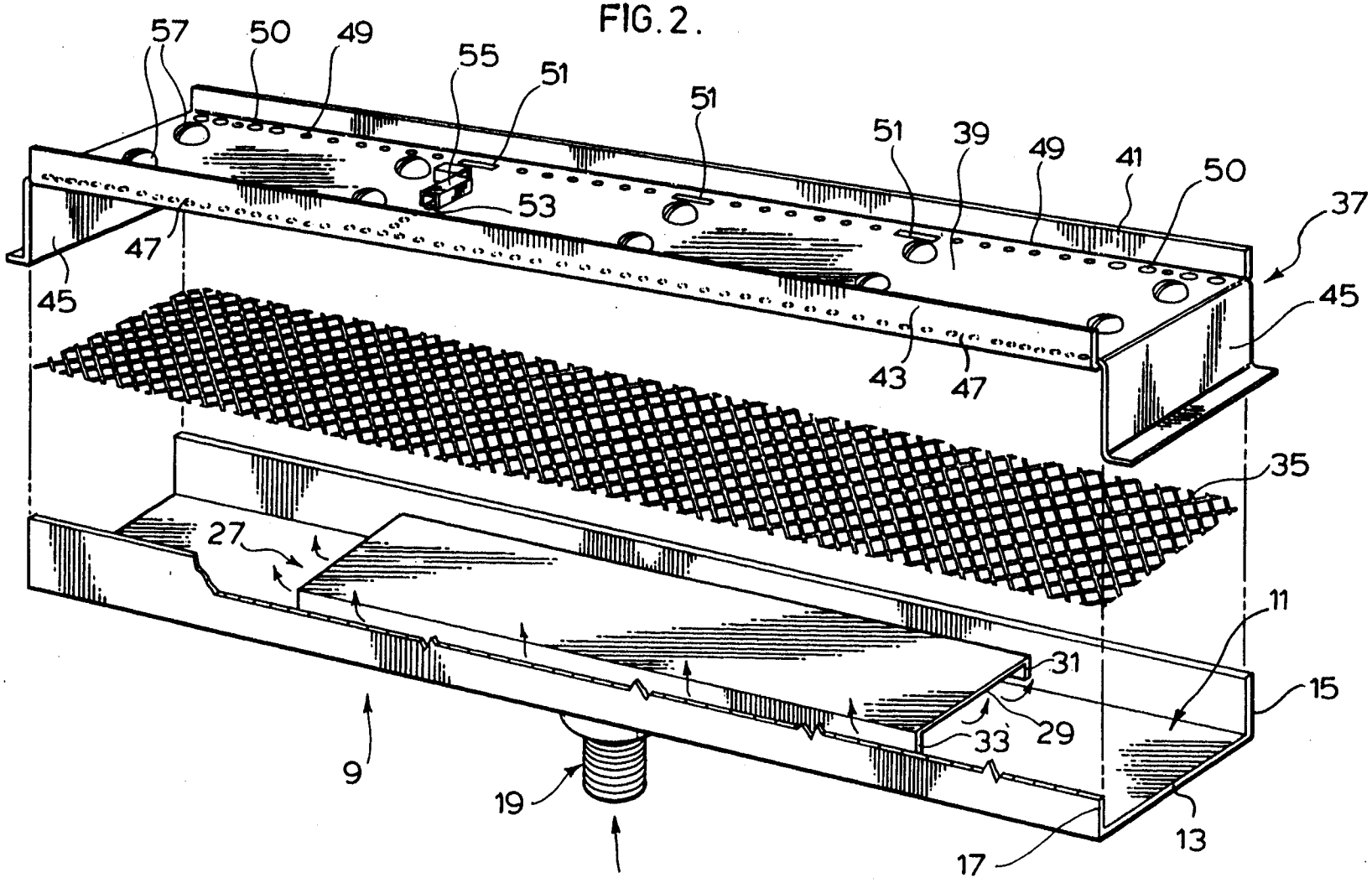
FIG. 2 is an exploded perspective view of the gas burner from the fireplace of FIG. 1.
Figure 4:
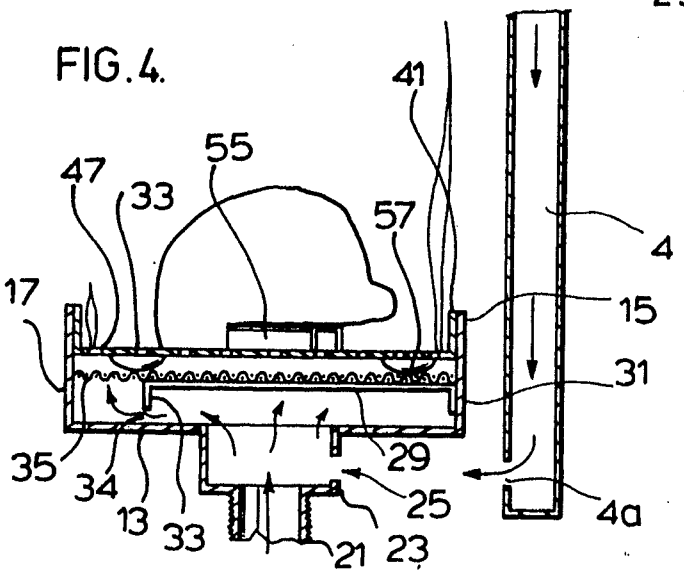
FIG. 4 is a sectional view looking into the burner of FIG. 3.

FIG. 2 of the drawings shows in detail the various components forming burner 9. More particularly, the burner comprises a main supporting frame 11 having a base 13, an upwardly turned rear wall 15 and an upwardly turned forward wall 17. A gas feed 19 is fitted generally centrally to the base 13 of the main frame. The gas feed itself which is also shown in FIGS. 3 and 4 comprises a threaded nipple 21 which would attach directly to a gas line to the burner and an upper air gas mixture chamber 23. Chamber 23 includes a side opening 25 which allows combustion air to mix with gas fed to the burner through nipple 21. According to the overall fireplace design, this combustion air is brought down through a conduit 4 along the back wall of the combustion chamber from an air intake pipe (not shown) drawing air from outside of the building in which the fireplace is located. The combustion air feeds through opening **4*a* located in the lower end of the conduit 4 and feeds directly to opening 25 in the mixing chamber 23 as best seen in FIG. 4 of the drawings. Note also from FIG. 4 that the entire burner assembly 9 is located in close proximity to the back wall of the combustion chamber which provides a very substantial preheat of the combustion air brought in through conduit 4**.

Returning to FIG. 2 of the drawings, a baffle generally indicated at 9 is provided internally of support frame 13. This baffle has an inverted U-shaped configuration comprising a top wall 29, a rear downwardly turned wall 31 and a forward downwardly turned wall or lip 33. As well shown in FIG. 2 of the drawings, baffle 27 is substantially shorter than support frame 11 and is additionally narrower from front to back than the support frame. The relative front to back depths of the support frame and the baffle are best seen in FIG. 4 of the drawings.

Baffle 27 is secured along its back wall or lip 31 to the rear wall 15 of the support frame. The baffle is elevated relative to the base 13 of the support frame such that there is a gas flow region 34 beneath the downwardly turned forward wall 33 of the baffle. This is again shown in FIG. 4 of the drawings. As best seen in FIG. 2 of the drawings, baffle 27 is located generally centrally of support frame 11 with opposite ends of the support frame extending outwardly beyond the ends of the baffle.

Located directly above baffle 27 is a gas distributor screen 35. This screen has an open mesh construction and is very effective in distributing or spreading gas both lengthwise and widthwise across the burner as to be described later in detail.

Located above screen 35 is a top plate generally indicated at 37. This top plate comprises a base or bottom wall 39 with an upwardly turned rear wall 41 and an upwardly turned forward wall 43. Provided in the base 39 of the top plate are a plurality of downwardly pressed dimples 57 which when the entire burner is assembled as shown in FIG. 3 of the drawings provide a stand off elevating the base 39 of the top plate slightly from the distributor screen 35. This feature is again shown in FIG. 4 of the drawings.

When the burner is fully assembled, screen 35 sits atop baffle 27 and the top plate 37 wedges into the main frame 11 seated at its dimples and the distributor screen. The rear and forward walls 41 and 43 of the top plate fit directly to the inside of the rear and forward walls 15 and 17 of the main frame. Top plate 37 includes downwardly extending opposite end legs 45 which block off the ends of the frame 11 when the burner is assembled.

The base of the top plate has, as shown in FIGS. 2 and 3 of the drawings a substantially solid, i.e. non-perforated central region with a series of gas openings being provided along the front and back regions of base 39 of the top plate. A log stand 55 is also provided on the top plate and a line of gas transfer holes 53 feeds between the front and back edge regions of the top plate. These are however the only holes or gas openings extending across the otherwise solid central region of the top plate.

The gas openings along the rear edge of the top plate are divided into openings of different sizes. These include a series of very small gas openings 49, some slightly larger gas openings 50 near opposite ends of the top plate and substantially larger gas openings 51 located more towards the middle back of the top plate. A series of small gas openings 47 run along the front edge of the top plate.

The gas burner operates as follows. Gas is fed up through the gas connection nipple 19 and outside air which is drawn into the burner feeds through opening 25 into chamber 23 to provide a highly combustible air gas mixture feeding upwardly through the bottom of the support frame internally of the burner. Baffle 29 prevents the gas from immediately rising but rather directs the air gas mixture to various different areas on the burner. Some of the air gas mixture will escape beneath the lower front leg of the baffle through passage 34 directly to the front openings 47 of top plate 37.

Much of the gas impinging on the baffle is redirected sideways towards the opened ends of the baffle where it then flows onto distributor screen 35. This screen rather than being smooth has a rather rough construction which enhances the gas distributing properties of the screen, i.e. the gas tends to catch on the screen which then spreads the gas in all directions across the burner. Since the top plate is raised relative to the screen through the provision of dimples 57 the gas has an effective channel through which it flows along the length of the screen beneath the top plate. Some of the gas will flow directly up off of the screen to those gas openings 49 and 50 which are located axially outside of the baffle at opposite ends of the top plate. Additional gas will flow around the ends of the baffle onto screen 35 which then redirects the gas back inwardly beneath the top plate to the remaining gas openings 49 and larger gas openings 51 which are blocked from direct exposure to the gas inlet by means of baffle. It is important that baffle 27 block direct escape of the gas to the larger openings 51 because the gas if permitted would take the path of least resistance and substantially all of it would flow directly to openings 51 with very little if any dispersion of the gas to the smaller openings near the outside of the top plate.

The purpose for providing the line of openings 53 traversing the plate is to ensure that the gas feeds substantially uniformally both to the front and the back of the burner. Openings 53 therefore provide a very effective gas transfer across the plate.

As the gas is fed to the burner and spreads to the top plate as described immediately above, it is ignited to produce the flame pattern shown in FIGS. 1 and 3 of the drawings. This flame pattern comprises a relatively insignificant low flame along the front of the burner and a much more substantial flame pattern to the center rear of the burner. The non-combustible log seated atop the burner iscontoured such that the larger flame pattern at the rear of the burner appears directly behind the log with a lower flame to the outside of the rear of the log. This is a very desirable overall flame pattern from an esthetic standpoint. Furthermore and as earlier described the higher central flame pattern at the rear of the burner provides a very efficient means of heating the incoming combustion air fed centrally along the outside of the back wall of the combustion chamber to the burner.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A gas fireplace burner comprising an elongated support frame formed with a base wall having a gas opening through said base wall and said base wall being bordered by upright front and rear frame walls, and burner components held within said support frame, said burner components comprising a baffle, a gas distributor and a top plate all of which extend lengthwise of said support frame between said front and rear frame walls, end legs extending between said top plate and said base wall of said frame, said end legs forming a gas block at opposite ends of said burner, said baffle being above said base wall of said support frame and said gas distributor being positioned between said baffle and said top plate, said baffle being shorter than said top plate such that end portions of said top plate extend beyond said baffle at each end of said burner, said top plate having front and back edges adjacent said front and rear frame walls, said front edge of said top plate having a series of spaced apart flame ports therealong and said back edge of said top plate also having a series of spaced apart flame ports which include enlarged flame ports larger than any other of the flame ports in said top plate, said enlarged flame ports being positioned only directly above said baffle and not in said end regions of said top plate, and said other flame ports being provided in said end regions of said top plate.

2. A burner as claimed in claim 1, wherein said baffle has an inverted U construction comprising a rear vertical leg attached to said rear frame wall, a horizontal baffle plate parallel to and above said base wall of said frame and a forward horizontal leg parallel to and spaced from said front frame wall with a gas escape gap between said front vertical wall of said baffle and said base wall of said frame.

3. A burner as claimed in claim 2, wherein said gas distributor comprises a mesh screen seated on said: horizontal baffle plate.

4. A burner as claimed in claim 3, wherein said top plate has an undersurface provided with a plurality of downwardly directed bosses which sit on said horizontal baffle plate.

5. A burner as claimed in claim 1, including a further series of flame ports extending across between said front and rear edges of said top plate.

* * * * *